US011490195B2

(12) United States Patent
Nowakowski et al.

(10) Patent No.: US 11,490,195 B2
(45) Date of Patent: Nov. 1, 2022

(54) LOUDSPEAKER ENCLOSURE AND MODULATION METHOD FOR A LOUDSPEAKER ENCLOSURE

(71) Applicant: AKOUSTIC ARTS, Paris (FR)

(72) Inventors: Thibault Nowakowski, Villejuif (FR); Ilan Kaddouch, Ile Saint Denis (FR)

(73) Assignee: AKOUSTIC ARTS, Paris (FR)

( * ) Notice: Subject to any disclaimer, the term of this patent is extended or adjusted under 35 U.S.C. 154(b) by 0 days.

(21) Appl. No.: 17/286,755

(22) PCT Filed: Oct. 17, 2019

(86) PCT No.: PCT/FR2019/052470
§ 371 (c)(1),
(2) Date: Apr. 19, 2021

(87) PCT Pub. No.: WO2020/079377
PCT Pub. Date: Apr. 23, 2020

(65) Prior Publication Data

US 2021/0377656 A1 Dec. 2, 2021

(30) Foreign Application Priority Data

Oct. 17, 2018 (FR) ..... 1871197

(51) Int. Cl.
*H04R 1/40* (2006.01)

(52) U.S. Cl.
CPC ..... *H04R 1/403* (2013.01)

(58) Field of Classification Search
CPC combination set(s) only.
See application file for complete search history.

(56) References Cited

U.S. PATENT DOCUMENTS 5,269,307 A * 12/1993 Fife ..... G01S 15/8918 600/447
6,968,062 B1 * 11/2005 Inanaga ..... H04R 5/033 398/140
7,123,724 B1 * 10/2006 Pfaffinger ..... H04R 5/02 381/1
2002/0042577 A1 4/2002 Hatangadi et al.
(Continued)

FOREIGN PATENT DOCUMENTS

JP 2004-112211 4/2004
WO 2014/076707 5/2014

OTHER PUBLICATIONS

International Search Report for PCT/FR2019/052470 dated Feb. 28, 2020, 6 pages, with English Translation.
(Continued)

*Primary Examiner* — Duc Nguyen
*Assistant Examiner* — Assad Mohammed
(74) *Attorney, Agent, or Firm* — Nixon & Vanderhye

(57) ABSTRACT

Disclosed is a loudspeaker enclosure including: —at least two sources suitable for producing ultrasound signals, and—a supply designed to process and amplify at least one input signal so as to produce, for the sources, supply signals of the same frequency and of different phases, wherein the supply are configured to apply different gains and/or phase shifts to at least two different frequency components of at least one of the supply signals. Also disclosed is a method for signal modulation for such an ultrasonic loudspeaker enclosure.

20 Claims, 8 Drawing Sheets

(56) References Cited

U.S. PATENT DOCUMENTS

2007/0183605 A1* 8/2007 Yoshino ..... H04R 3/12 381/59
2009/0118619 A1* 5/2009 Oshiki ..... G01S 7/52085 600/459
2009/0161880 A1 6/2009 Hooley et al.
2009/0254289 A1* 10/2009 Vivek ..... B06B 1/0622 702/54
2010/0278346 A1* 11/2010 Hogue ..... H04S 7/308 381/17
2015/0071463 A1* 3/2015 Niemisto ..... G10L 21/0208 381/94.5
2015/0116039 A1* 4/2015 Ahmed ..... H03F 1/0233 330/295
2015/0138925 A1* 5/2015 Yen ..... G01S 7/5202 367/138
2015/0208166 A1* 7/2015 Raghuvanshi ..... H04S 7/303 381/71.6
2015/0304789 A1* 10/2015 Babayoff ..... H04R 1/403 381/303
2016/0007960 A1* 1/2016 Son ..... A61B 8/14 601/3
2017/0289684 A1* 10/2017 Chang ..... H04R 3/14
2018/0082697 A1* 3/2018 Iwase ..... H04R 5/033 398/140
2018/0331660 A1* 11/2018 Høyerby ..... H04S 7/308 381/17

OTHER PUBLICATIONS

Written Opinion of the ISA for PCT/FR2019/052470 dated Feb. 28, 2020, 15 pages, with English Translation.
Kamakura et al., "Parametric audible sounds by phase-cancellation excitation of primary waves", Acoustics 08 Paris, Jun. 29-Jul. 4, 2008, pp. 4367-4372.

* cited by examiner

Fig.3
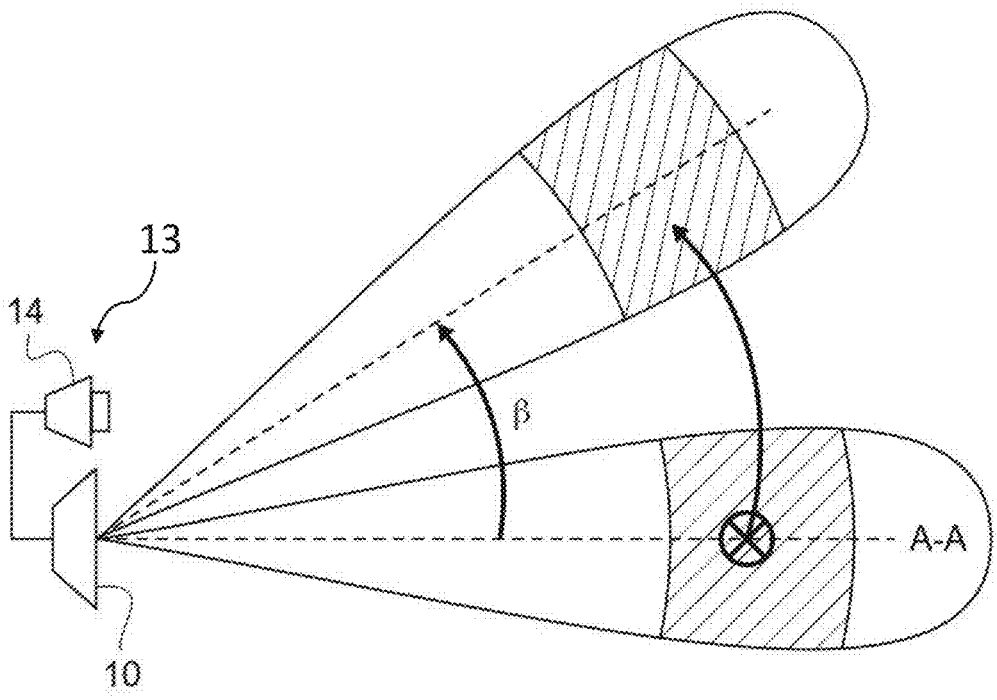
Fig.4
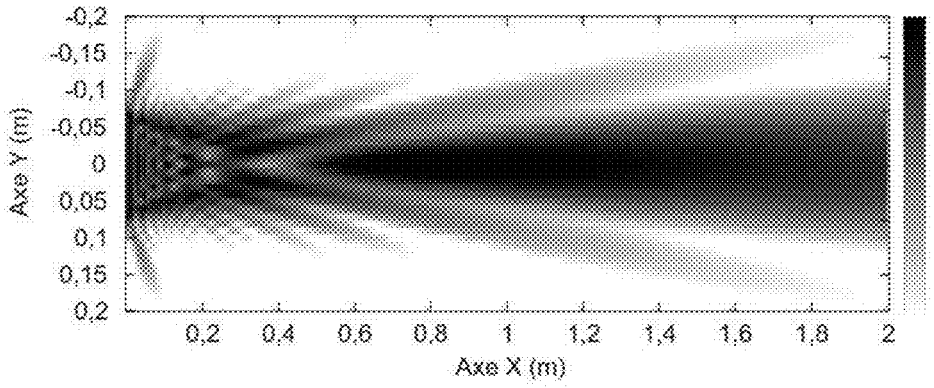
Fig.5
| SU | 1 | 2 | 3 | 4 | 5 | 6 | 7 | 8 |
|---|---|---|---|---|---|---|---|---|
| φ | 5,444 | 5,444 | 4,966 | 2,2618 | 3,4805 | 2,4709 | - | 0 |
| γ | 0 dB | 0 dB | 0 dB | 0 dB | 0 dB | 0 dB | -60 dB | 0 dB |

LOUDSPEAKER ENCLOSURE AND MODULATION METHOD FOR A LOUDSPEAKER ENCLOSURE

CROSS-REFERENCE TO RELATED APPLICATION

This application is the U.S. national phase of International Application No. PCT/FR2019/052470 filed Oct. 17, 2019 which designated the U.S. and claims priority to FR Patent Application No. 1871197 filed Oct. 17, 2018, the entire contents of each of which are hereby incorporated by reference.

BACKGROUND OF THE INVENTION

Field of the Invention

The present invention generally relates to the field of directional loudspeaker enclosures, and in particular those which use the acoustic nonlinearity properties of air to recreate audible sound from ultrasounds.

It more particularly relates to a loudspeaker enclosure comprising at least two sources capable of producing ultrasound signals, and supply means adapted to process and amplify an input signal in such a way as to produce, for said sources, supply signals of different amplitudes and phases.

The invention finds a particularly advantageous application when a sound has to be broadcast to a single listener or to a reduced number of listeners, in a limited volume, at a distance from the loudspeakers.

DESCRIPTION OF THE RELATED ART

The acoustic nonlinearity properties of air make it possible to recreate audible sound from only ultrasounds. Indeed, when two ultrasound waves, emitted at a high sound level (typically above 100 dB), propagate in the air, they interact with each other by converting a part of their energy to form two new waves whose frequencies are, on the one hand, the difference between the two ultrasound frequencies and, on the other hand, the sum between the two ultrasound frequencies. If the "sum" wave is in the ultrasound domain and is hence inaudible, the "difference" wave is in the audible domain from the moment that the frequency gap between the two ultrasound waves is lower than 20 kHz. This nonlinear phenomenon, occurring in the air, is called "self-demodulation". This acoustic effect occurs at each point of the ultrasound beam emitted by the loudspeaker as long as the residual energy of the ultrasound waves is high enough to generate it. All the demodulated audible waves at one point of the beam propagate along the latter and interact constructively with the demodulated audible waves at the next point (their amplitudes add each other, it is talked about a virtual antenna). That way, a new beam appears, called secondary beam. Its directivity is similar to that of the ultrasound beam, because the demodulated audible waves interact a little out of the ultrasound beam.

In order to implement an ultra-directional emission system to broadcast audio signals, the first step to be carried out is to translate the audio signals, comprised between 20 Hz and 20 kHz, to the ultrasound domain. For that purpose, the amplitude modulation, a method from the telecommunication field, is implemented. An ultrasound carrier (or carrier ultrasound signal) is modulated by the input audio signal. It results therefrom a modulated signal whose bandwidth, of about 20 kHz, is exclusively in the ultrasound domain. This modulated signal is transmitted to piezoelectric transducers that enter into vibration and emit in the air the corresponding ultrasound waves according to a broadcast cone.

Several theoretical and experimental studies are known from the document "Parametric audible sounds by phase cancellation excitation of primary waves", de T. Kamakura, S. Sakai, H. Nomura and M. Akiyama, presented at the conference Acoustics'08 Paris in 2008. These laboratory studies have proposed methods to significantly reduce the level of the ultrasound carrier at the centre of the ultrasound beam. The simplest method is to consider a circular emitting surface. By adding a second, independent, ring-shaped emitting surface about the circular surface, so that the two surfaces have the same surface area, it is possible to modulate the signals to be transmitted with two carriers of same frequency but different phases on each surface. Hence, by suitably choosing the phase of the carrier emitted on the ring surface, the two carriers interact destructively at a certain distance of propagation and cancel each other. The dimensioning of the emitting antenna hence allows varying the distance at which the beams emitted by each surface cancel each other. The studies have shown that the demodulated audible levels are only a little impacted by the carrier cancelling.

This method suffers from drawbacks. On the one hand, the reduction of amplitude of the carrier is valid only at the centre of the total ultrasound beam, which is uncomfortable and impractical for the listener. On the other hand, the secondary lobes of the beam are hence increased, which may modify the directivity of the enclosure and cause an exposure of the listener to non-desired ultrasound levels.

SUMMARY OF THE INVENTION

The invention aims to remedy these drawbacks in such a way as to guarantee the quality and level of the sound signal perceived by the listener by reducing the power levels of the ultrasound waves emitted.

In order to achieve this objective, the invention relates to a loudspeaker enclosure, at least one of said supply signals of which has a level of amplification different from that of the other supply signals.

Hence, the invention relates to a loudspeaker enclosure comprising:

- at least two sources capable of producing ultrasound signals, and
- supply means adapted to process and amplify at least one input signal so as to produce for said sources supply signals of same frequency and different phases,
- wherein the supply means are configured to apply distinct gains and/or phase shifts to two distinct frequency components of one at least of the supply signals.

Hence, the invention provides in particular a better control of the ultrasound beam, and in particular of the size of the main lobes of the different frequency components of the ultrasound beam, and hence of those of the demodulated beam, i.e. the audible beam, as well as a reduction of the ultrasound carrier level on a wider area than those obtained up to now, thus widening the listening area.

Advantageously, applying a distinct gain to different frequency components of the signal makes it possible to more easily increase the size of the main lobe, while reducing the secondary lobes, whereas applying a distinct phase-shift to different frequency components makes it possible to more easily decrease the size of the main lobe.

A combination of distinct gains and phase-shifts makes it possible to more easily and more efficiently obtain a compromise between the size of the main lobe and that of the secondary lobes.

Advantageously, this improved control prevents the emergence of secondary lobes of too high levels. Another notable advantage is the management of the sanitary effects due to prolonged exposure to ultrasound waves. Indeed, although no standard is established in France as regards the prolonged exposure to ultrasound waves, different organizations and countries propose tables of levels of exposure according to the frequency bands and the listening durations, the invention makes it possible to respect these tables.

The gains and phase-shifts may be apodization functions depending on the frequency of the frequency component.

The gains and phase-shifts may be apodization functions depending on the position of the ultrasound source.

The apodization functions are particularly advantageous because they allow an efficient reduction of the secondary lobes.

According to a feature of the invention, the ultrasound sources are concentric and extend as a ring about a central source. This feature allows, when implementing a differentiated supply according to the invention, obtaining a better efficiency than the prior art enclosure. By "efficiency", it is meant the ratio between the mean level of the audible signal resulting from the constructive demodulation of the ultrasound waves and the mean level of the ultrasound waves.

According to an embodiment of the invention, the supply means are configured to:

- receive a first channel signal and a second channel signal,
- sum the frequency components located in a lower frequency band of the two channel signals so as to form a low-frequency signal,
- sum the frequency components located in an upper frequency band of the first, respectively second, channel signals with the low-frequency signal, so as to form a first, respectively second, input signal,
- generate a first supply signal for a first source from the first input signal, a second supply signal for a second source from the second input signal and a third supply signal for the central source from the low-frequency signal.

It is therefore possible to generate, with a same enclosure, two audible signals forming for example a stereophonic audio signal. Here, only the highest frequency components of the channel signals are stereophonically emitted, the lowest frequency components being combined and emitted by all the sources. This advantageously allows optimizing the sound power; indeed, although the audible level, that is to say the sound power of the signal, is proportional to the emitting surface, it is also proportional to the square of its frequency. Hence, for the highest frequencies, the attenuation generated by the distribution of the high-frequency components of each of the channel signals on only certain of the ultrasound sources is negligible.

Advantageously, the first source and the second source can form together a same ring extending about the central source.

Thus, a same ring of the audio enclosure is used at the generation of the stereophonic signal. The enclosure hence remains compact.

According to another feature of the invention, said at least two sources are sets of at least two piezoelectric transducers, adjacent two-by-two to define a substantially continuous surface. The transducers are juxtaposed and, as they are generally cylindrical in shape, they cannot cover a totally continuous surface, they form a substantially continuous surface. The use of piezoelectric transducers to emit ultrasounds signals is simple and cheap, and known for this type of enclosure. The choice of the model of piezoelectric transducers can be made as a function of the size of the enclosure, as well as of the desired listening area.

According to a feature of the invention, the supply means comprise a signal processor adapted to generate, from an audio input electric signal, supply signals resulting from the modulation of a carrier of frequency substantially higher than 20 kHz by said input signal. The carrier, whose characteristics are its frequency fp, its phase $\varphi n$ and its level of amplification $\gamma n$, corresponds to the modulation of the input signal intended for the $n^{th}$ source. A signal processor can include different modulation elements and tools, known by the person skilled in the art and easy to install.

According to another feature of the invention, the supply means are adapted to generate one differentiated supply signal for each of the ultrasound transducers of the enclosure and forming parts of the ultrasound sources.

According to another feature of the invention, the enclosure comprises means for locating a listener in real time, and the supply signals are processed and amplified as a function of the position of said listener. Hence, it is possible to define a listening area that changes according to the position of the listener. These location means can comprise a position sensor of the infrared camera type that detects in real time the position of the listener. The listener is free to move, while keeping the same sound level. Moreover, this adaptability makes it possible to guarantee that the listener is never exposed, over a long period of time, to too high ultrasound levels in the area close to the enclosure. Another advantage is that, if a third party comes between the listener and the enclosure, the sound level will be adapted to this third party and hence the latter won't either be exposed to too high levels of ultrasounds.

According to another feature of the invention, the supply signal results from a modulation of amplitude or frequency or pulse width of a carrier by the input signal. These modulation methods are known by the person skilled in the art.

The invention also relates to a modulation method for a loudspeaker enclosure comprising the following steps:

- a step of defining at least two sources of the emitting surface of the enclosure;
- a step of supplying each of the sources with a supply signal resulting from the modulation of a carrier of same frequency by an input signal, for each of said sources, said carrier having a different level of amplification and a different phase for at least one source,
- a step of applying distinct gains and/or phase-shifts to at least two frequency components of one at least of the supply signals.

The gains and phase-shifts can be apodization functions depending on the frequency of the frequency component.

The gains and phase-shifts can be apodization functions depending on the position of the ultrasound source.

The method can comprise a step of applying distinct phase-shifts to at least two frequency components of at least one supply signal.

According to an embodiment, the enclosure includes half-ring first source and second source forming together a same ring extending about a central source, the method comprising:

a step of receiving a first channel signal and a second channel signal, a step of summing the frequency components located in a lower frequency band of the two channel signals so as to form a low-frequency signal, a first, respectively second, step of summing the frequency components located in an upper frequency band of the first, respectively second, channel signal with the low-frequency signal, so as to form a first, respectively second, input signal, a step of generating a first supply signal for the first source from the first input signal, a second supply signal for the second source from the second input signal, and a third supply signal for the central source from the low-frequency signal.

According to a feature of the method according to the invention, the sources are sets composed of at least two piezoelectric transducers, adjacent two-by-two to define a substantially continuous surface.

According to another feature of the invention, the adjustment of the level of amplification and phases of the carriers of the sources is such that the ultrasound level of the carrier is reduced by destructive interferences, over at least the listening area.

Of course, the different alternatives and embodiments of the invention can be associated with each other according to various combinations, insofar as they are not incompatible with each other or exclusive from each other.

Likewise, the different features, alternatives and implementations of the method according to the invention can be associated with each other according to various combinations, insofar as they are not incompatible with each other or exclusive from each other.

BRIEF DESCRIPTION OF THE DRAWINGS

Moreover, various other features of the invention emerge from the appended description made with reference to the drawings that illustrate non-limitative embodiments of the invention, and in which:

FIG. 3 is a schematic view of the acoustic perception cone of the ultrasound enclosure illustrated in FIG. 2 when supplied;

FIG. 4 shows, in axial cross-section, the intensity of the ultrasound field emitted by the enclosure illustrated in FIG. 2 when all the ultrasound sources of the enclosure are supplied with the same signal resulting from the modulation of the carrier by the acoustic signal;

FIG. 5 shows a table of phase values and normalized amplification levels for the supply signals of ultrasound sources of the enclosure according to FIG. 2, within the framework of implementation of the method according to the invention;

DESCRIPTION OF THE PREFERRED EMBODIMENTS

It is to be noted that, on these figures, the structural and/or functional elements common to the different alternatives can have the same references.

Figure 1:
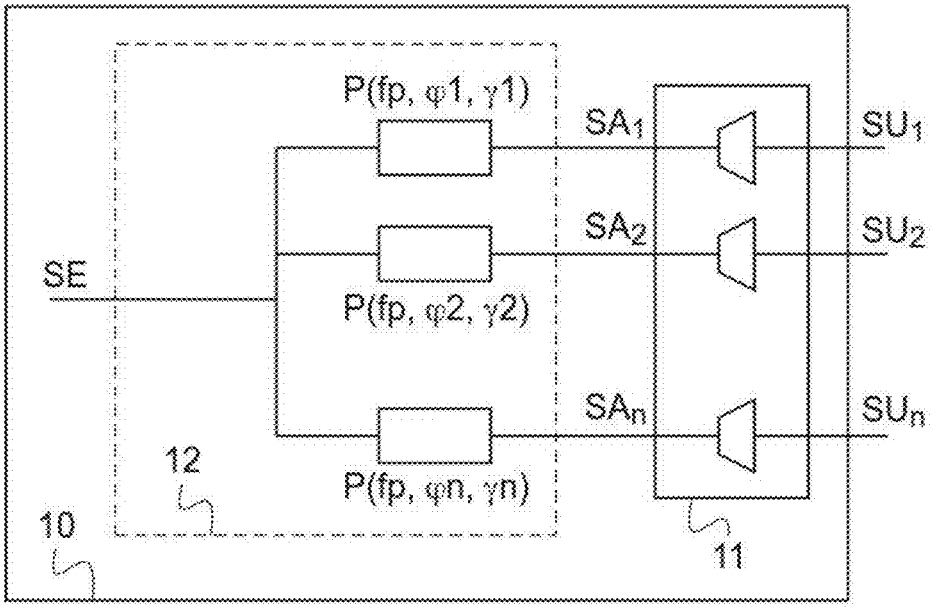
FIG. 1 is a schematic diagram of a loudspeaker enclosure according to the invention comprising n ultrasound sources.

A unidirectional enclosure 10 according to the invention, as schematically illustrated in FIG. 1, comprises a series of ultrasound sources SU1 to SUn, wholly denoted by the reference 11. The sources 11 are supplied by supply means 12 performing the processing of an input audio signal SE.

The supply means 12 are adapted to generate from the input audio signal SE as many supply signals SA1 to SAn as the enclosure comprises ultrasound sources SU1 to SUn. The supply means can in particular be consisted by a dedicated signal processor but also by any other suitable signal processing system resulting from the assembly of discrete and/or integrated electronic components.

The input audio signal SE is generated from an audio source, such as a telephone, a computer, a hi-fi system, connected to the enclosure, for example by an audio cable. A Bluetooth or Wi-Fi box is also conceivable to collect this input audio signal SE. The input audio signal can also come from a suitable system integrated to the enclosure 10, comprising means for reading a memory, removable or not, and means for generating an input audio signal substantially corresponding to the signal liable to supply a sound transducer, such as for example an earphone.

The supply means 12 are then suitable to modulate ultrasound carriers P from the input audio signal SE to generate the supply signals SAn. The carriers P all have the same relatively high frequency fp in the ultrasound domain, higher than 20 kHz, and are generated from a reference carrier. However, the supply means 12 are adapted to apply, according to the needs of the method according to the invention, different levels of amplification and phases with respect to the reference carrier to the supply signals SA1 to SAn supplying the ultrasound sources SU1 to SUn, respectively. Hence, the supply signal SAn supplying the source SUn results from the modulation of the reference carrier by the input signal SE with an associated amplification or gain $\gamma n$ and an associated phase-shift $\varphi n$. Thus, there will have n levels of amplification $\gamma$ and n phases $\varphi$.

According to an essential feature of the invention, on the one hand, at least one level of amplification associated with an ultrasound source has a value different from that of at least one level of amplification associated with another ultrasound source and, on the other hand, at least one phase-shift associated with an ultrasound source has a value different from that of at least one phase-shift associated with another ultrasound source. In other words, all the levels of amplification have not the same value and all the phase-shifts have not either the same value.

Figure 2:
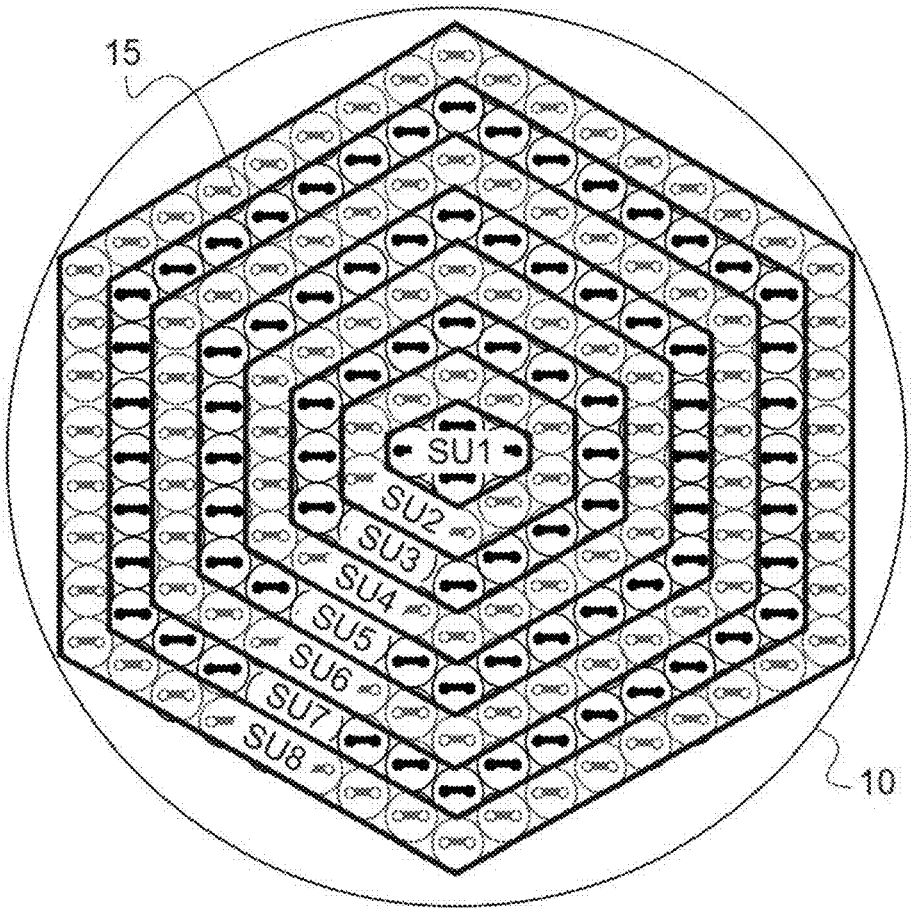
FIG. 2 is a schematic front view of an enclosure according to the invention comprising eight concentric ultrasound sources each comprising a plurality of ultrasound transducers.

In order to implement this signal control or modulation method for a directional loudspeaker enclosure, the invention proposes to make and arrange the ultrasound sources as illustrated in FIG. 2.

Hence, according to this embodiment of the invention, the enclosure 10 comprises two hundred piezoelectric transducers 15 that here have a cylindrical shape of same diameter, distributed over a substantially regular hexagonal surface inscribed in a circle C. The cylindrical transducers are arranged in such a way as to pave at best the hexagonal surface, knowing that no transducer is centred on the centre of the hexagonal surface.

According to the illustrated example, the two hundred transducers are divided into eight groups each forming an ultrasound source. The eight sources 11 are arranged concentrically and hence all centred on the centre of the hexagonal surface and of the circle C. Hence, a first source occupies a central area of the hexagonal surface and comprises four transducers inscribed in a hexagon. The sever other sources are consisted of concentric rings of substantially hexagonal shape, each ring being paved by transducers and having a width substantially equivalent to the diameter of an ultrasound transducer.

The sources 11 are piloted by the supply means 12 that provide, for each source 11, a supply signal, respectively SA1 to SA8.

During the supply of the ultrasound sources by the supply means 12, acoustic waves are emitted in the air with a perception cone schematically illustrated in FIG. 3. This cone corresponding to the region of space in which the ultrasound waves have a sufficient intensity to generate, by self-demodulation, an acoustic signal perceptible by the human ear, in other words, audible. This perception cone has an apex angle lower than 50° and whose axis AA passes by the centre of the enclosure, that is the reason why it is talked about a directional enclosure. There exists, in the perception cone, a listening area, hatched in FIG. 3, in which a listener is liable to perfectly hear the acoustic signal resulting from the self-demodulation of the ultrasound waves. The distance from the listing area to the enclosure results from the characteristics of modulation of the carrier P by the input audio signal SE.

During the supply of all the ultrasound sources and hence of all the transducers by a single and same signal resulting from the modulation of the carrier P by the input signal SE, as proposed by the prior art, that is to say when all the sources are supplied with the same level of amplification and the same phase-shift with respect to the carrier, a section of the ultrasound field generated by the enclosure is illustrated in FIG. 4. This field corresponds to that which is required to allow a satisfying quality listening in the listening area. Now, it appears that the darkest area in which the intensity is the most important is relatively extended, so that a subject located in the perception cone is subjected to a relatively high ultrasound intensity that might not to respect the exposure level recommendations.

The invention makes it possible to remedy this drawback by providing a differentiated supply of the ultrasound sources. Thus, in accordance with the modulation method according to the invention, the supply means are adapted to apply differentiated phase-shift and amplification to each of the supply signals SA1 to SA8 whose phase and level of amplification of the ultrasound carrier P are different (the frequency of the carriers being identical for each source 11).

According to the illustrated example, the levels of amplification of the carrier P for the different ultrasound sources SU1 to SU8, as defined hereinabove, evolve in normalized values between 0 dB and −60 dB. The phases of the carrier for these different sets of transducers 15 evolve between $-\pi$ rad and $\pi$ rad. FIG. 5 is a table indicating the characteristics of the supply signals of each of the ultrasound sources in phase-shift and amplification with respect to the carrier.

Figure 6:
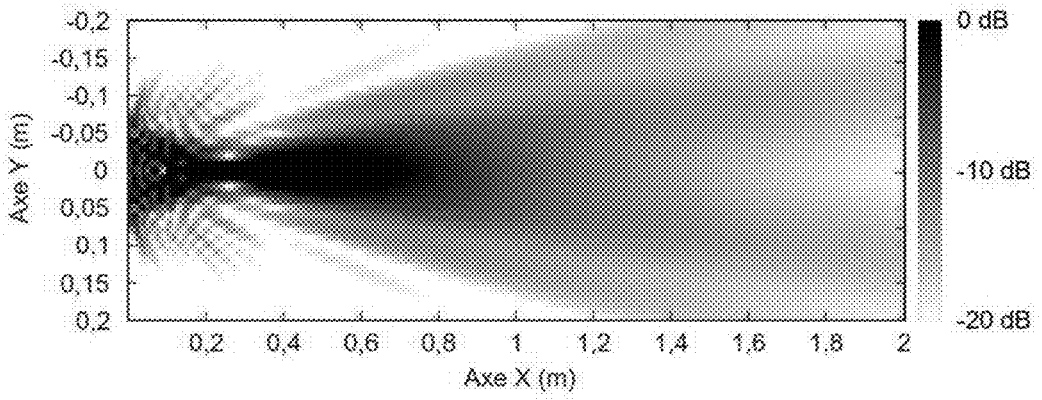
FIG. 6 shows, in axial cross-section, the intensity of the ultrasound field emitted by the enclosure illustrated in FIG. 2 when all the ultrasound sources of the enclosure are supplied with the supply signals according to the table of FIG. 5.

During the supply of the sources SU1 to SU8 of the enclosure according to the invention with such signals, it results therefrom the emission of an ultrasound field whose intensity seen in axial section of the perception cone corresponds to FIG. 6. It appears that the high-intensity regions are less extended than in the case of the uniform supply of the ultrasound sources even though the quality of perception of the sound signal by a listener is substantially identical.

The invention hence allows reducing the levels of exposure to ultrasound waves while keeping a listening comfort identical to that provided by the prior art. In this respect, comparative measurements have been performed in order to evaluate the ultrasound and audible (demodulated) levels, at a distance of 1.5 m from the emitting surface of the enclosure as illustrated in FIG. 2 in three distinct modes of implementation.

In a first mode of implementation, mode 1, all the transducers of the enclosure are supplied with an identical signal, in such a way that the enclosure behaves as a single ultrasound source.

In a second mode of implementation, mode 2, the enclosure is implemented in accordance with the method of the invention, in such a way as to differentiate therein eight ultrasound sources, a central one and seven concentric ring ones, supplied with supply signals having differentiated phase-shifts and gains. In this second mode of implementation, the respective phase-shifts and gains have been selected in such a way as to obtain an attenuation of −10 dB, with respect to the first mode, of the ultrasound level measured at 1.5 m from the emitting face of the enclosure defined by the substantially coplanar emitting faces of the transducers.

In a third mode of implementation, mode 3, the enclosure is supplied as in mode 1 so as to form a single ultrasound source, but the amplification or the gain of the single amplification signal is chosen in such a way as to obtain an attenuation of −10 dB, with respect to the first mode, of the ultrasound level measured at 1.5 m from the emitting face of the enclosure, that is to say the same level of attenuation as in the second mode.

For the three modes of implementation, it has been proceeded to measurements at several points of measurement distributed in a circle of 20 cm diameter in front of the enclosure. The table below indicates the mean of the measurements with, for reference in the case of the ultrasound level, the first mode of implementation and, in the case of the demodulated (audible) sound, the mean ultrasound level at the enclosure in the considered mode.

TABLE 1

| Relative levels | Mode 1 | Mode 2 | Mode 3 |
|---|---|---|---|
| Ultrasounds | 0 dB | −10 dB | −10 dB |
| Demodulated sound | −45 dB | −59 dB | −69 dB |

It appears that, in Mode 2, corresponding to the implementation of the method according to the invention, we obtain, with a same ultrasound level, an audible signal of a level higher than that obtained in Mode 3, that is to say with a single-source ultrasound enclosure. The invention hence allows reducing the level of ultrasound exposure by reducing the impact of this decrease on the level of the demodulated, and hence audible, signal. The invention hence allows increasing the efficiency of the enclosure, that is to say the ratio between the ultrasound power emitted and the power of the audio signal audible by a user in the listening area.

Figure 7:
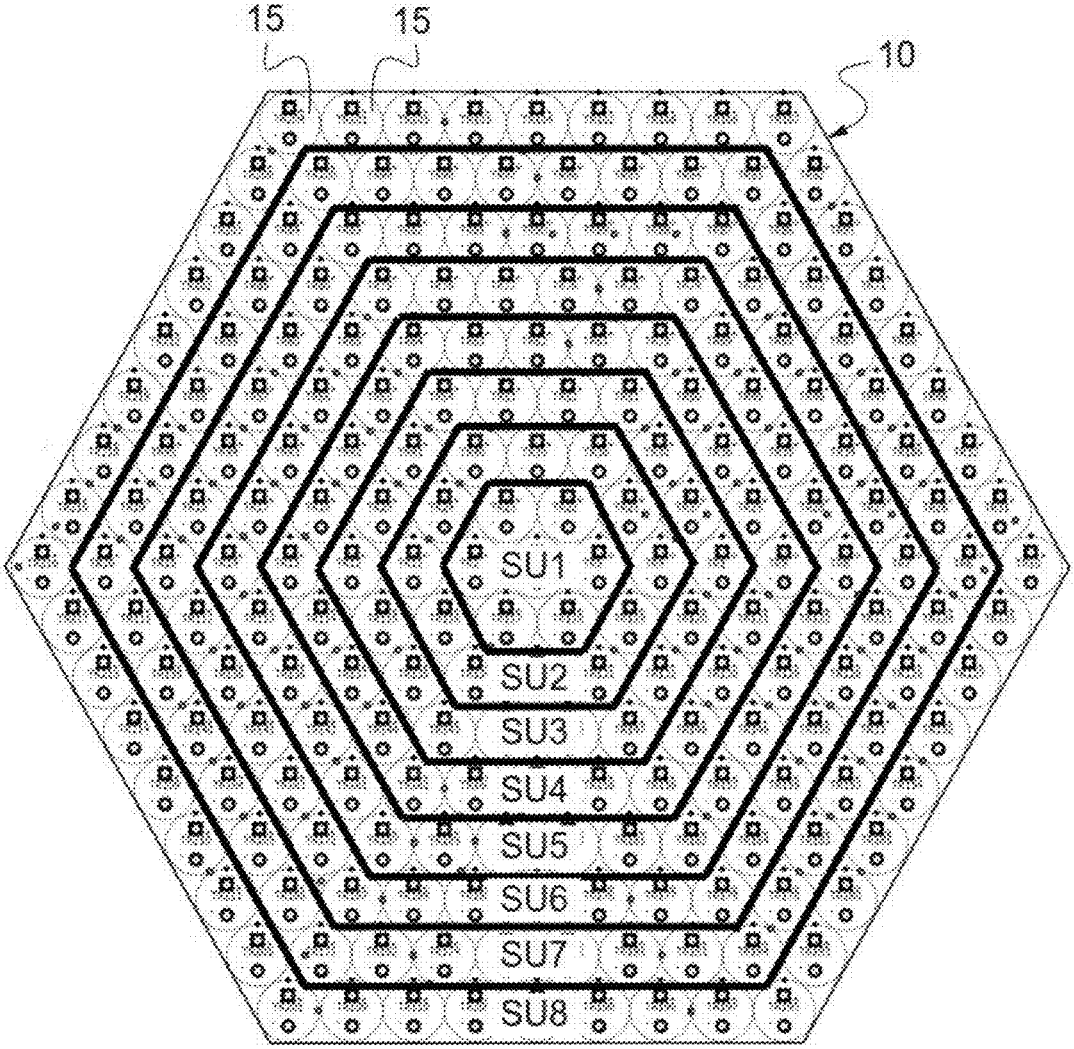
FIG. 7 is a schematic front view of an alternative of the enclosure according to the invention comprising eight concentric ultrasound sources each comprising a plurality of ultrasound transducers.

According to an alternative embodiment of the invention more particularly illustrated in FIG. 7, the transistors of the ultrasound sources are arranged in the hexagon corresponding to the active surface of the enclosure 10 so that a transducer is perfectly concentric with the centre of the hexagon. The first ultrasound source SU1, occupying a central position, then comprises seven ultrasound transducers placed is staggered rows. The seven ring sources SU2 to SU8 then surround the central source SU1 by each having the width of one transducer, while keeping the arrangement in staggered rows. Such a configuration makes it possible to obtain a greatest density of transducers 15. Hence, it is possible to place 217 transducer, whereas according the shape illustrated in FIG. 2, there are 200 transducers arranged in a hexagon of same surface area.

Moreover, in another embodiment of the invention and in such a way as to allow angularly offsetting the axis of the perception cone with respect to the axis AA of the enclosure, the supply means 12 are adapted to apply a temporal phase-shift to the input signal located in the acoustic spectrum before the modulation of the carrier by the so-phase-shifted input signal. More precisely, the supply means are adapted to induce a temporal phase-shift of the differentiated input signal for each of the transducers of an ultrasound source and that, for all the ultrasound sources of the enclosure. This temporal phase-shift is then determined as a function of the distance from each transducer to a plane passing by a target point located in the listening area or as a function of the distance from each transducer to the so-called target point. The sound signals corresponding to each of the transducers are then used to modulate the carrier in such a way that as many signals are obtained as the enclosure comprises transducers. In accordance with the method of the invention, all the ultrasound signals of the transistors of a same ultrasound source receive the phase-shift and the gain corresponding to said source and liable to be different from those which are associated with the other ultrasound sources. Hence, the ultrasound beam is oriented in space while keeping the assurance that the phase and level of amplification of each carrier allow destructive interferences reducing the ultrasound level at the listening position of the user.

Within the framework of this embodiment, the enclosure comprises or is associated with means 13 for locating the listener. These location means 13 can comprise a position sensor 14 shown in FIG. 3. The adjustment of the sources 11 is then made as a function of these real-time data. The position sensor 14 can be a camera or any other device making it possible to know the position of the listener.

Figure 8:
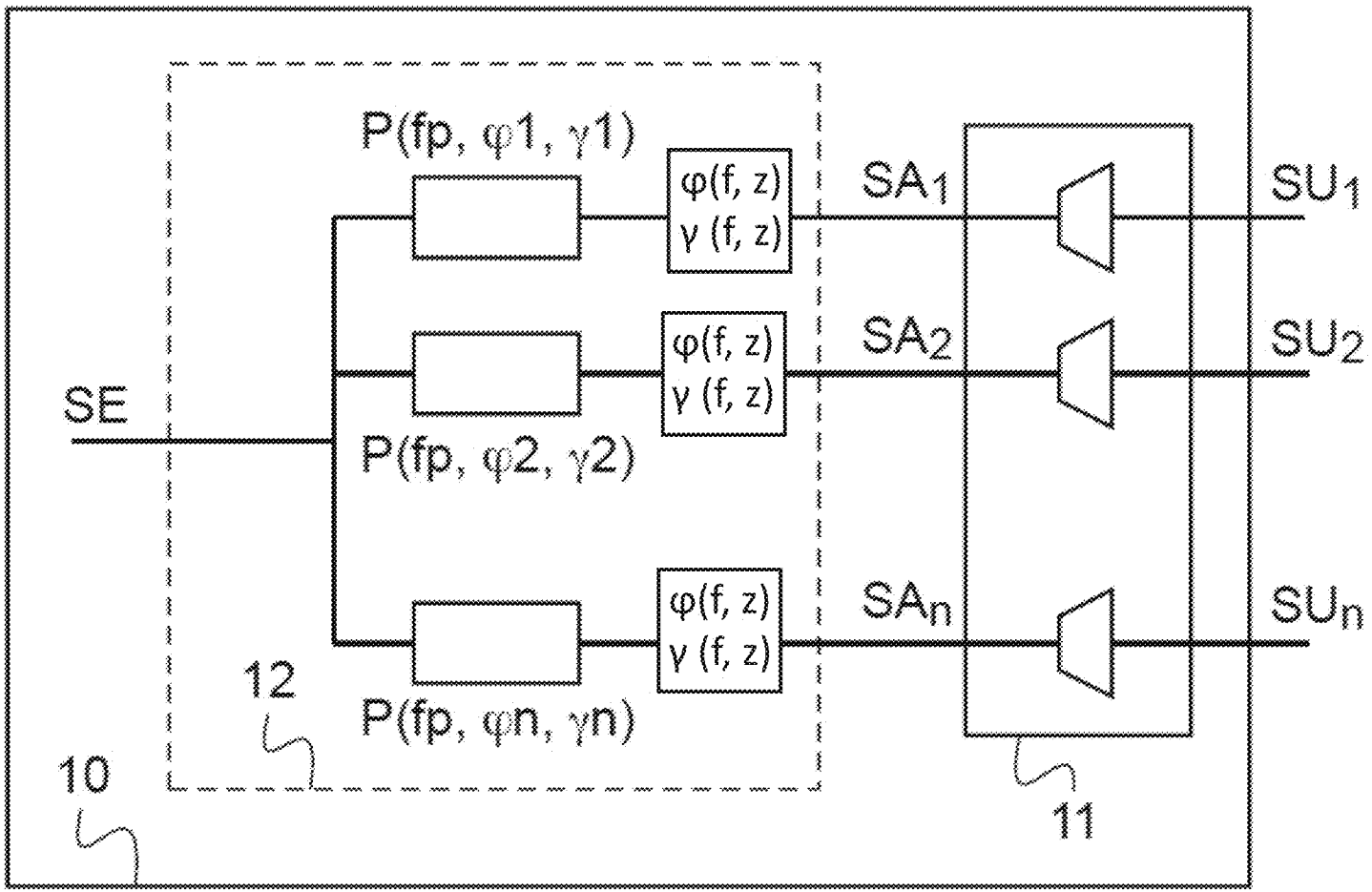
FIG. 8 is a schematic diagram of a loudspeaker enclosure according to an embodiment of the invention, comprising n ultrasound sources.

As an alternative embodiment of the invention illustrated in FIG. 8, the supply means 12 are configured to apply a distinct gain to different frequency components of the supply signals SA. For example, the supply means 12 are configured to apply to each supply signal a gain $\gamma(f,z)$ whose value is a function of the frequency f and of the position z of the source SU receiving the supply signal. In particular, the value of the gain $\gamma(f,z)$ is herein defined by an apodization function. As a variant, the gain could depend only of the frequency for only of the position z of the source SU.

Moreover, the supply means 12 are here configured to apply a distinct phase-shift to different frequency components of the supply signals. For example, the supply means 12 are configured to apply to each supply signal SA a phase-shift $\varphi(f,z)$ whose value is function of the frequency f of the supply signal SA and of the position z of the ultrasound source SU. As an alternative, the phase-shift could depend only of the frequency f of the supply signal SA or only of the position z of the ultrasound source SU.

As an alternative, the supply means could be configured to apply only a distinct gain or only a distinct phase-shift to the different frequency components.

For example, the apodization functions can be chosen among the conventional functions, such as the Hamming window, the Hann window, the Nuttall window, the Blackman window, a rectangular window, or also a combination of these functions.

Moreover, the apodization functions could be custom-defined, as a function of the desired application. For example, the definition of the apodization function can be made during an experimental phase including a measurement of the directivity of the demodulated frequency components, that is to say the attenuation of the demodulated frequency components according to their position with respect to the enclosure and a corresponding modification of the gain and phase-shift values of the ultrasound frequency components of the supply signals SA in such a way as to uniformize the directivity of the demodulated (audible) frequency components and hence to obtain a clearer listening area. As a variant, it is also possible to use, during the experimental phase, a nonlinear acoustic model making it possible to predict the directivity of the demodulated frequencies as a function of the directivity of the carrier and of the ultrasound (modulated) frequency component.

Figure 9:
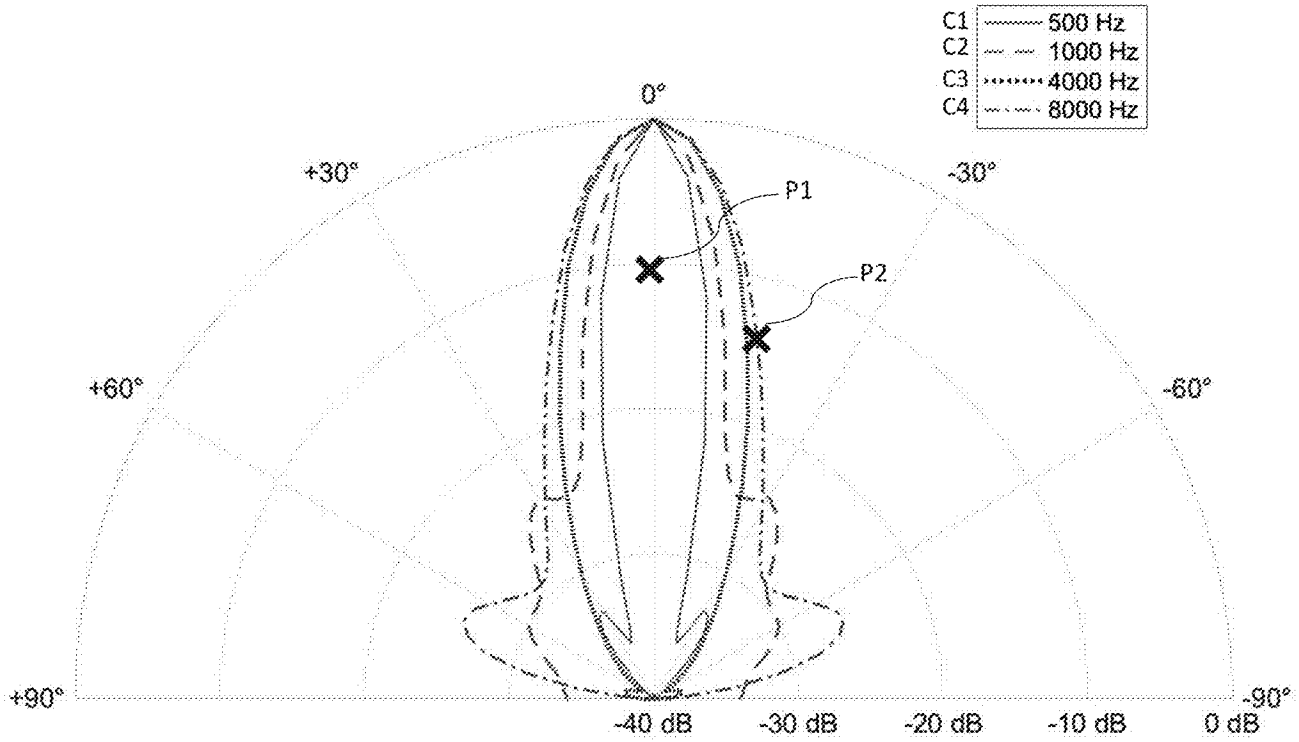
FIG. 9 shows certain components of an audible beam of a directional enclosure.
Figure 10:
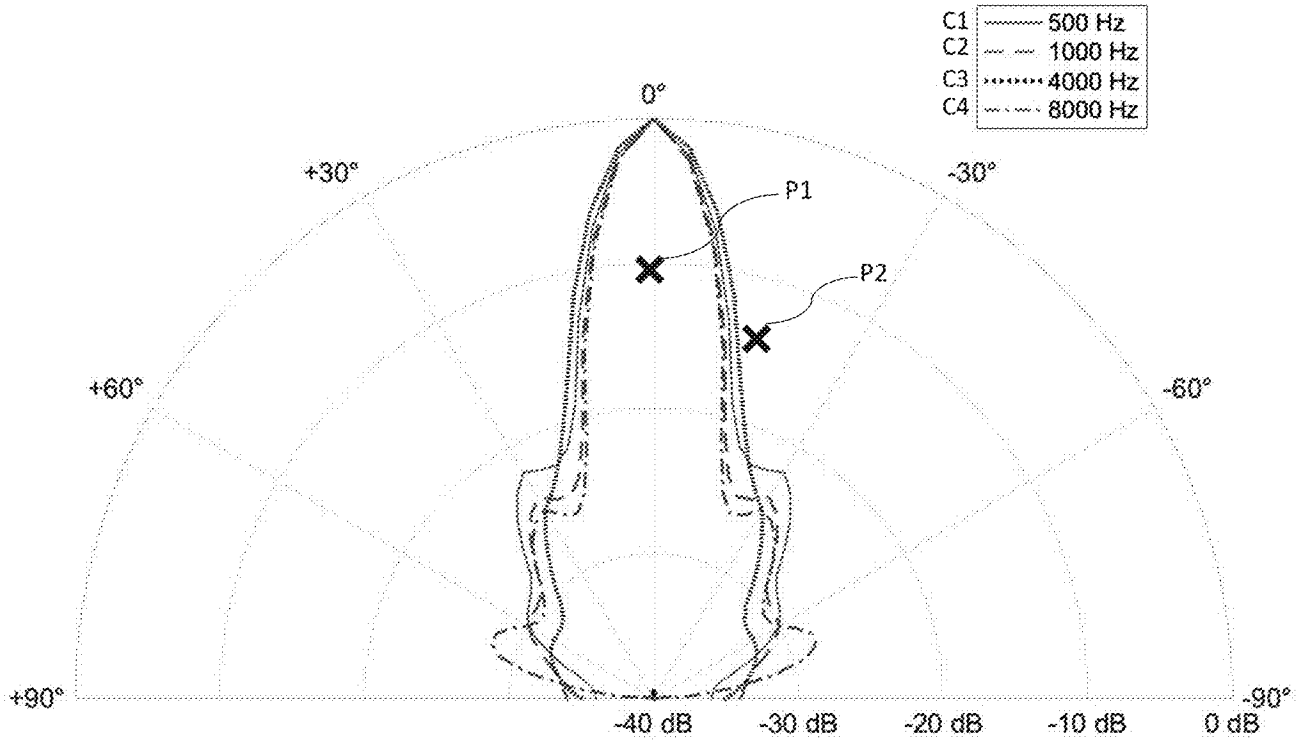
FIG. 10 shows certain components of an audible beam of an enclosure according to an embodiment of the invention.

FIGS. 9 and 10 are polar diagrams representing the directivity of four frequency components C1, C2, C3, C4 of the demodulated beam emitted by two enclosures and corresponding respectively to the frequencies 500 Hz, 1000 Hz, 4000 Hz, 8000 Hz. For the simplification of the figures, only these four components have been shown, although the demodulated beam comprise others components.

In FIG. 9, these components are those of a demodulated beam emitted by a directional enclosure in which the supply means apply no gain nor phase-shift to the different frequency components of the supply signals.

It distinctly appears that the different demodulated frequency components have different shapes. Hence, a listener located at a first position P1 in front of the enclosure would hear a good-quality signal including all these frequency components.

However, if positioned at a second position P2, the listener would perceive only certain of these frequency components, that is to say that he would perceive a degraded and hence annoying sound.

In FIG. 10, the components C1 to C4 are those of an audible beam emitted by an enclosure according to the embodiment described hereinabove in connection with FIG. 8. It appears distinctly that the different frequency components C1 to C4 have similar sizes and geometries.

Hence, at the first position P1, the listener always hear a good-quality sound including all the frequency components C1 to C4. At the second position P2, the listener no longer hears the audio signal at all.

Hence, as the geometries of the components of the audible beam are similar, the audible beam is better defined and the area of space in which the listener might perceive a degraded sound is strongly reduced.

Figure 11:
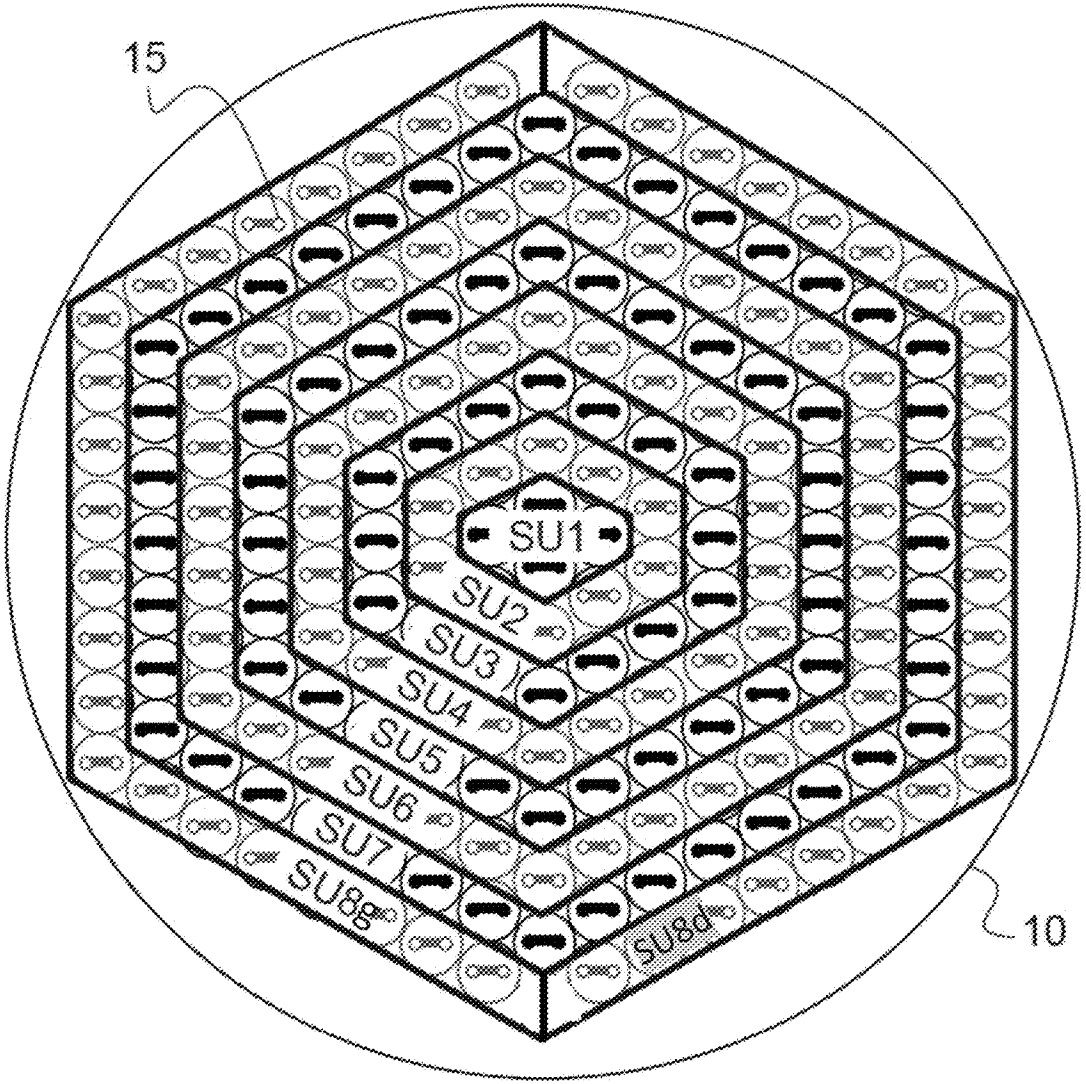
FIG. 11 is a schematic front view of a stereophonic loudspeaker enclosure according to an embodiment of the invention comprising seven concentric ring ultrasound sources and two half-ring sources, each comprising a plurality of ultrasound transducers.

According to an alternative illustrated by FIG. 11, the enclosure 10 is a stereophonic enclosure. Hence, the arrangement of the sources is similar to that described in connection with FIG. 2 and the enclosure 10 includes the seven sources SU1 to SU7, and two half-ring sources instead of the above-mentioned source SU8.

The enclosure 10 includes a left half-ring source SU8*g* and a right half-ring source SU8*d* forming a ring extending about the sources SU1 to SU7, called the central sources, and specifically along the seventh source SU7.

Figure 12:
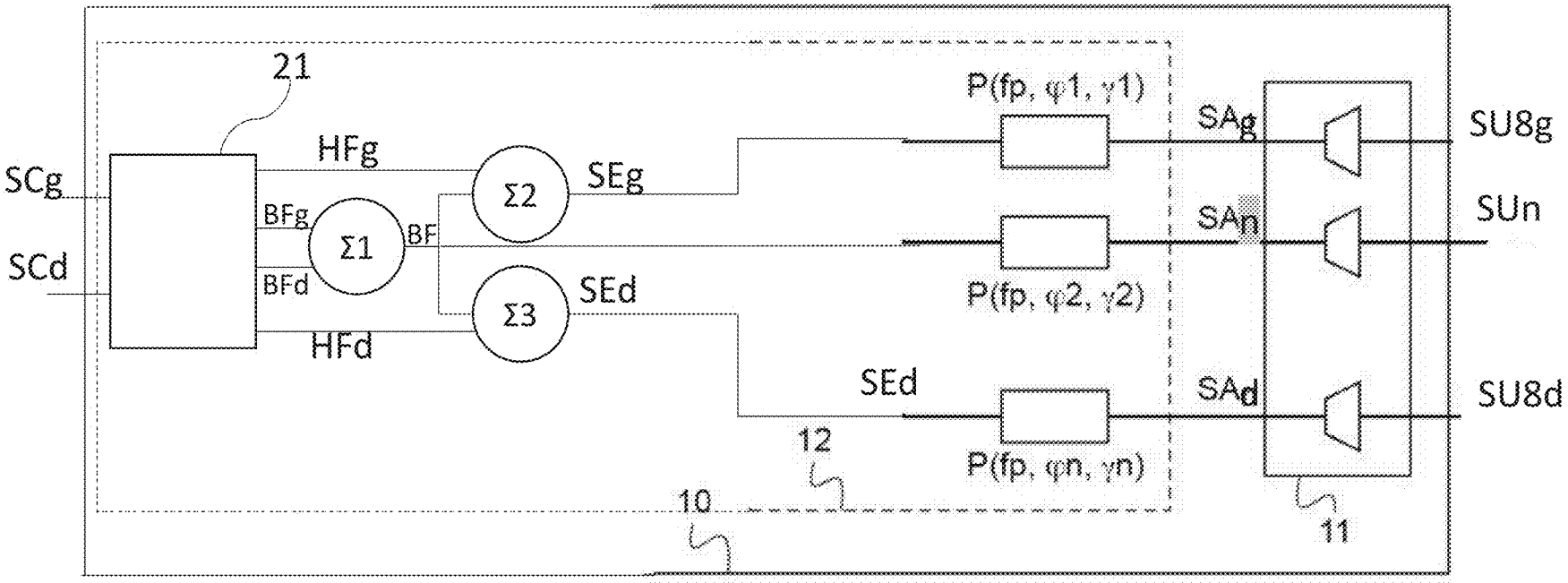
FIG. 12 is a schematic diagram of a stereophonic loudspeaker enclosure according to an embodiment of the invention and comprising n ultrasound sources.

FIG. 12 schematically illustrates the stereophonic enclosure according to the invention in which the supply means include a block 21 of frequency-band separating filters.

According to this embodiment, the supply means 12 are configured to receive a first channel signal SCg, or left signal, and a second channel signal SCd, or right signal, and to sum the frequency components BFg and BFd located in a lower frequency band of the two channel signals SCg and SCd, for example but not limitatively a frequency band comprised between 100 Hz and 4 kHz, so as to form a low-frequency signal BF.

The supply means 12 are further configured to make a first sum of the frequency components HFg located in an upper frequency band of the first channel signal SCg, for example but not limitatively a frequency band between 4 kHz and 16 kHz, with the low-frequency signal BF, so as to form a first input signal SEg, or left input signal, and to make a second sum of the frequency component HFd located in the upper frequency band of the second channel signal SCd, with the low-frequency signal BF, so as to form a second input signal SEd, or right input signal.

It would be perfectly possible to chose different frequency bands, for example a lower frequency band between 100 Hz and 8 kHz and an upper frequency band between 8 kHz and 16 kHz. The choice of the frequency bands can for example depend on the configuration of the enclosure, in particular the number and/or the nature of the transducers, the size of the emitting surface of the enclosure, etc.

The supply means 12 are configured to generate a supply signal SAg for the left half-ring source SU8*g* from the first input signal SEg, a second supply signal SAd for the right half-ring source SU8*d* from the second input signal SEd and a third supply signal SEc of the sources SU1 to SU7 from the low-frequency signal BF.

Although a stereophonic enclosure including only two half-ring sources has been described, the enclosure 10 could include more half-ring sources, and in particular only half-ring sources. The stereophonic enclosure could also include a different number of central sources.

According to the examples described hereinabove, the ultrasound sources are consisted of ultrasound transducers, all of same model and characteristics. However, the sources 11 can be composed of different models of transducers 15 having different acoustic characteristics such as a different resonant frequency, a different carrier frequency, a different bandwidth or a different frequency response. The adjustments will be made as a function of these new parameters.

Of course, various other modifications or alternatives of the enclosure or of the method according to the invention can be contemplated within the framework of the appended claims.

The invention claimed is:

1. A loudspeaker enclosure comprising:

a first source and at least one second source configured to produce ultrasound signals; and a supply system configured to process and amplify at least one input signal to produce supply signals of a same frequency and different phases for the first and at least one second sources, the supply system being configured to apply one or more of distinct gains and phase-shifts to at least two distinct frequency components of at least one of the supply signals.

2. The enclosure of claim 1, wherein the gains and phase-shifts are apodization functions depending on the frequency of the frequency component to which the gains and phase-shifts are applied.

3. The enclosure according to claim 1, wherein the gains and phase-shifts are apodization functions depending on the position of the respective ultrasound source to which the gains and phase-shifts are applied.

4. The enclosure according to claim 1, wherein the respective ultrasound sources are concentric and extend as a ring about a central source.

5. The enclosure according to claim 4, wherein the supply system is configured to:

receive a first channel signal and a second channel signal, sum the frequency components located in a lower frequency band of the two channel signals to form a low-frequency signal, sum the frequency components located in an upper frequency band of the respective first and second channel signals with the low-frequency signal to form respective first and second input signals, and generate a first supply signal for a first source from the first input signal, a second supply signal for a second source from the second input signal, and a third supply signal for the central source from the low-frequency signal.

6. The enclosure according to claim 4, wherein the first source and the at least one second source are half-rings and together form a same ring extending about the central source.

7. The enclosure according to claim 1, wherein the first source and said at least one second source are sets of at least two piezoelectric transducers, adjacent two-by-two, to define a substantially continuous surface.

8. The enclosure according to claim 7, wherein the supply system is configured to generate one differentiated supply signal for each of the ultrasound transducers of the enclosure and form parts of the respective ultrasound sources.

9. The enclosure according to claim 1, wherein the supply system comprises a signal processor configured to generate, from an input audio electric signal, supply signals resulting from the modulation of a carrier of a frequency substantially higher than 20 kHz by said input signal.

10. The enclosure according to claim 1, further comprising a detector configured to locate a listener in real time, and said supply signals are processed and amplified as a function of the position of said listener.

11. The enclosure according to claim 10, wherein the detector comprises a position sensor.

12. The enclosure according to claim 1, wherein the supply signal results in part from a modulation of amplitude or frequency or pulse width of a carrier by the input signal.

13. A modulation method for a loudspeaker enclosure, the method comprising:

defining a first source and at least one second source of an emitting surface of the enclosure;

supplying each of the first source and the at least one second source with a supply signal resulting from modulation of a carrier of same frequency by an input signal, said carrier having a different level of amplification and a different phase for at least one of the first source and at least one second source; and applying one or more of distinct gains and phase-shifts to at least two frequency components of at least one of the supply signals.

14. The method according to claim 13, wherein the gains and phase-shifts are apodization functions depending on the frequency of the frequency component.

15. The method according to claim 13, wherein the gains and phase-shifts are apodization functions depending on the position of the respective ultrasound source.

16. The method according to claim 13, wherein the first source and at least one second source together form a same ring extending about a central source, and the method further comprises:

receiving a first channel signal and a second channel signal;

summing the frequency components located in a lower frequency band of the two channel signals to form a low-frequency signal;

summing the frequency components located in an upper frequency band of the respective first and second channel signals with the low-frequency signal to form respective first and second input signals; and generating a first supply signal for the first source from the first input signal, a second supply signal for the second source from the second input signal, and a third supply signal for the central source from the low-frequency signal.

17. The method according to claim 13, wherein the first source and said at least one second source are sets composed of at least two piezoelectric transducers, adjacent two-by-two, to define a substantially continuous surface.

18. The method according to claim 13, wherein the adjustment of the level of amplification and phases of the carriers of said sources is such that the ultrasound level of the carrier is reduced by destructive interferences, over at least the listening area.

19. The enclosure according to claim 2, wherein the gains and phase-shifts are apodization functions depending on the position of the respective ultrasound source to which the gains and phase-shifts are applied.

20. The enclosure according to claim 2, wherein the respective ultrasound sources are concentric and extend as a ring about a central source.

* * * * *